US007306050B2

(12) United States Patent
Chen

(10) Patent No.: US 7,306,050 B2
(45) Date of Patent: Dec. 11, 2007

(54) TOOTHED RING CONNECTING STRUCTURE OF A POWER TOOL

(75) Inventor: Hsin-Chi Chen, Taiping (TW)

(73) Assignee: Tranmax Machinery Co., Ltd., Taichung Hsien (TW)

( * ) Notice: Subject to any disclaimer, the term of this patent is extended or adjusted under 35 U.S.C. 154(b) by 45 days.

(21) Appl. No.: 11/442,360

(22) Filed: May 30, 2006

(65) Prior Publication Data

US 2007/0251711 A1 Nov. 1, 2007

(30) Foreign Application Priority Data

Apr. 26, 2006 (TW) ..... 95207136 U

(51) Int. Cl.
*B25B 21/00* (2006.01)

(52) U.S. Cl. ..... 173/213; 173/216; 173/217; 81/57.13; 81/57.39

(58) Field of Classification Search ..... 173/213, 173/216, 217, 176, 178, 171; 81/57.13, 60, 81/57.39, 61, 57.3, 57.29
See application file for complete search history.

(56) References Cited

U.S. PATENT DOCUMENTS

| | | | | |
|---|---|---|---|---|
| 2,155,082 | A | 4/1939 | Decker | 173/217 |
| 4,411,173 | A | 10/1983 | Mixer | 60/695 |
| 4,641,551 | A | 2/1987 | Pascaloff | 475/263 |
| 4,974,475 | A | 12/1990 | Lord et al. | 81/57.13 |
| 5,142,952 | A | 9/1992 | Putney et al. | 81/57.39 |
| 5,231,901 | A | 8/1993 | Putney et al. | 81/57.39 |
| 6,165,096 | A | 12/2000 | Seith | 475/265 |
| 6,296,427 | B1 | 10/2001 | Potter et al. | 408/124 |
| 6,298,753 | B1 | 10/2001 | Izumisawa | 81/57.39 |
| 6,435,060 | B1 | 8/2002 | Izumisawa | 81/57.39 |
| 6,461,088 | B2 | 10/2002 | Potter et al. | 408/124 |

*Primary Examiner*—Scott A. Smith
(74) *Attorney, Agent, or Firm*—Rosenberg, Klein & Lee

(57) ABSTRACT

A toothed ring connecting structure of a power tool, including: a main body having a first opening and a second opening; a motor accommodated in the main body and having an output shaft extending from a first end of the motor; a fixing cap having a body section, a first end of the body section being fixed with the first end of the motor, the body section being formed with a shaft hole through which the output shaft of the motor is coaxially fitted, a second end of the body section being formed with a fixing thread hole, the fixing thread hole inward axially extending from the second end of the body section to coaxially communicate with the shaft hole; a toothed ring having a first end extending into the first opening of the main body and a second end extending out from the main body, the first end being formed with a first thread for screwing into the fixing thread hole, the second end being formed with a second thread; an operating end piece having a connecting end; and an adjustment threaded bush, one end of the adjustment threaded bush being coaxially screwed with the second thread of the toothed ring, the other end of the adjustment threaded bush being connected with the connecting end of the operating end piece.

6 Claims, 9 Drawing Sheets

TOOTHED RING CONNECTING STRUCTURE OF A POWER TOOL

BACKGROUND OF THE INVENTION

The present invention is related to a power tool, and more particularly to a toothed ring connecting structure of a power tool.

U.S. Pat. No. 6,915,721 discloses a power ratchet wrench in which a toothed ring is coaxially connected with a connector of the main body. Via the connector, the toothed ring is indirectly located in the hollow main body. A planet gear assembly is arranged in the toothed ring and engaged therewith.

According to the above arrangement, the toothed ring is simply coaxially adapted to the connector so that the toothed ring is not firmly fixed. After a period of use, the toothed ring tends to displace to affect the operation of the planet gear assembly. In addition, the toothed ring is not firmly located so that the toothed ring is often loosen due to the violate vibration of the power tool.

SUMMARY OF THE INVENTION

It is therefore a primary object of the present invention to provide a toothed ring connecting structure of a power tool, in which the toothed ring is connected with the main body by better strength.

It is a further object of the present invention to provide the above toothed ring connecting structure of the power tool, by which it is easier to replace the operating end piece according to actual requirement.

According to the above objects, the toothed ring connecting structure of the power tool of the present invention includes:

a main body with a predetermined length, the main body having an interior space and a first opening and a second opening at two ends;

a motor accommodated in the interior space of the main body, the motor having an output shaft extending from a first end of the motor in parallel to an axis of the main body;

a fixing cap having a body section, a first end of the body section being fixed with the first end of the motor, the body section being formed with a shaft hole through which the output shaft of the motor is coaxially fitted, a second end of the body section being formed with a fixing thread hole with a predetermined inner diameter, the fixing thread hole inward axially extending from the second end of the body section by a predetermined depth, the fixing thread hole coaxially communicating with the shaft hole, a free end of the output shaft being positioned within the fixing thread hole;

a toothed ring has a ring body coaxially aligned with the fixing thread hole, a first end of the toothed ring extending into the first opening of the main body, a second end of the toothed ring extending out from the main body, a first thread being formed on an outer circumference of the first end of the ring body inside the main body for coaxially screwing into the fixing thread hole, a second thread being formed on an outer circumference of the second end of the ring body outside the first opening of the main body;

an operating end piece having a connecting end with a predetermined outer diameter; and an adjustment threaded bush, one end of the adjustment threaded bush being coaxially screwed with the second thread of the toothed ring, the other end of the adjustment threaded bush being connected with the connecting end of the operating end piece, whereby the operating end piece is connected with the toothed ring.

The present invention can be best understood through the following description and accompanying drawings wherein:

DETAILED DESCRIPTION OF THE PREFERRED EMBODIMENTS

Figure 1:
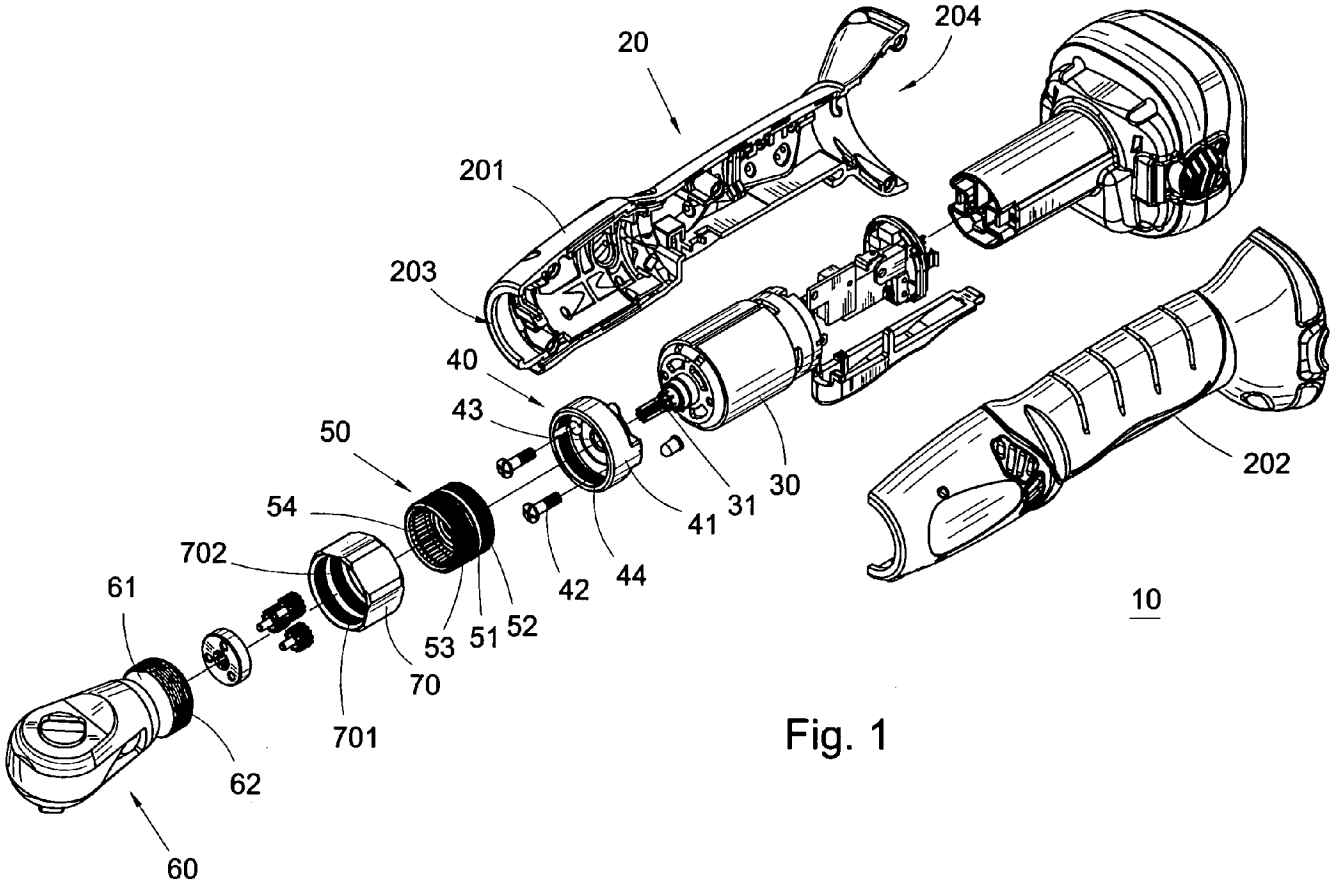
FIG. 1 is a perspective exploded view of a first embodiment of the present invention.
Figure 2:
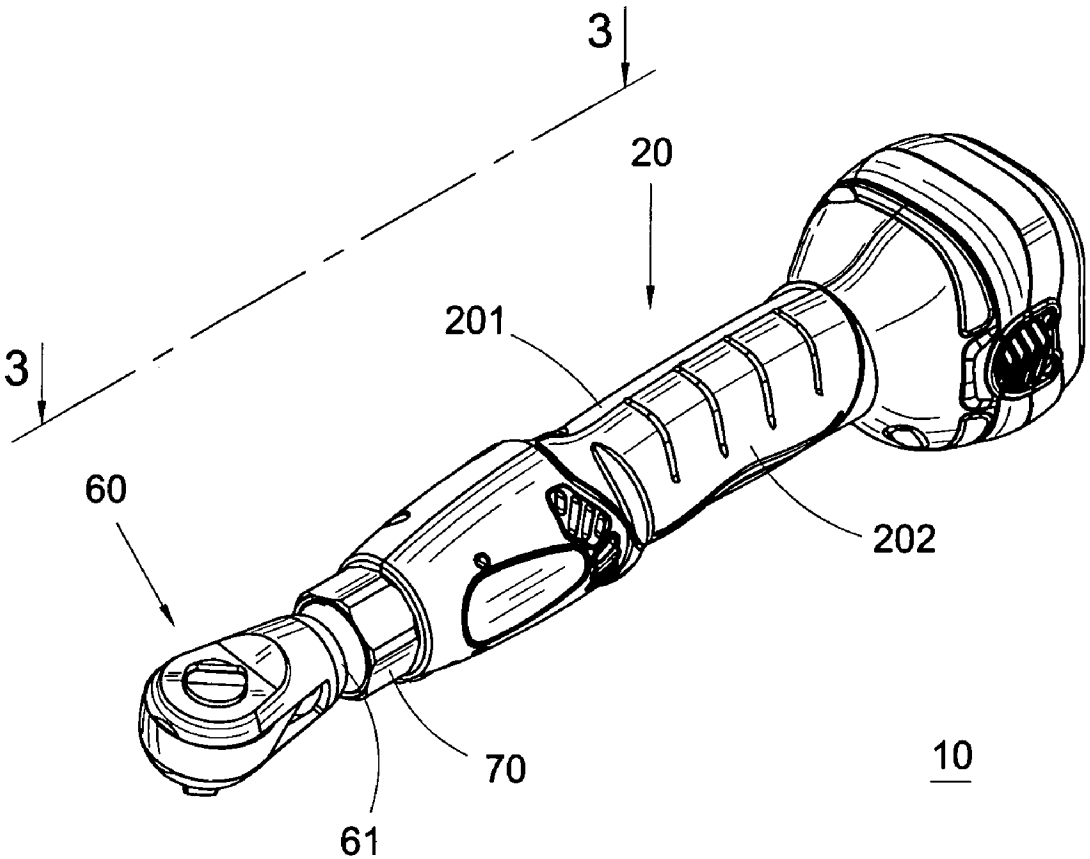
FIG. 2 is a perspective assembled view of the first embodiment of the present invention.
Figure 3:
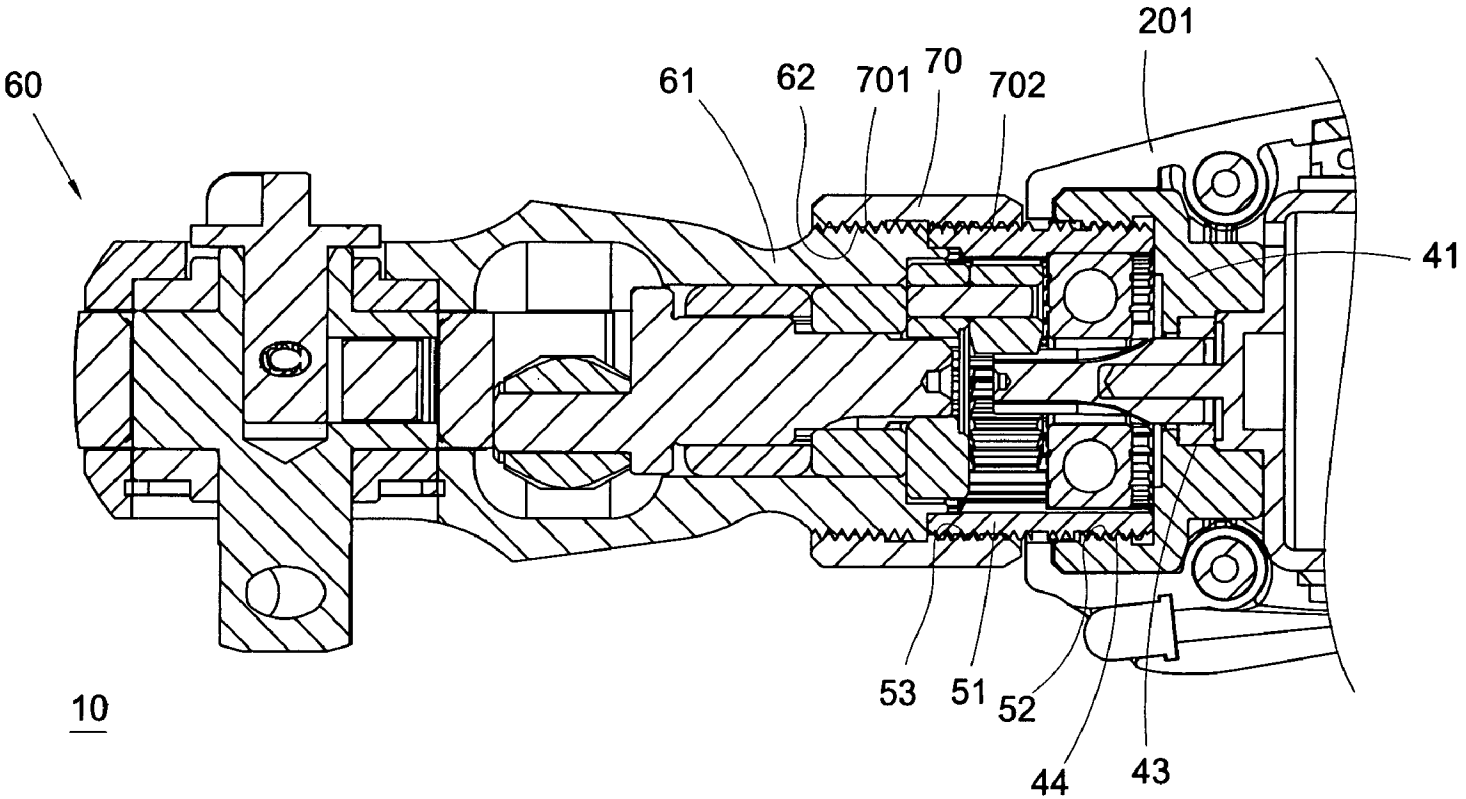
FIG. 3 is a sectional view taken along line 3-3 of FIG. 2.

Please refer to FIGS. 1 to 3. The present invention 10 includes a main body 20, a motor 30, a fixing cap 40, a toothed ring 50, an operating end piece 60 and an adjustment threaded bush 70.

The main body 20 is an elongated body composed of two casings 201, 202 mated with each other. The main body 20 has an interior space and a first opening 203 and a second opening 204 at two ends.

The motor 30 is accommodated in the interior space of the main body 20 and fixed between the inner faces of the two casings 201, 202. The motor 30 has an output shaft 31 extending from a first end of the motor 30 in parallel to the axis of the main body 20.

The fixing cap 4 has a circular body section 41. A first end of the body section 41 abuts against the first end of the motor 30. The fixing cap 40 is fixed with the motor 30 with bolts 42. The body section 41 is formed with a shaft hole 43 through which the output shaft 31 is coaxially fitted. A second end of the body section 41 is formed with a fixing thread hole 44 with a certain inner diameter. The fixing thread hole 44 inward axially extends from the second end of the body section 41 by a certain depth. The fixing thread hole 44 coaxially communicates with the shaft hole 43. A free end of the output shaft 31 is positioned within the fixing thread hole 44.

The toothed ring 50 has a ring body 51 with a certain outer diameter. The toothed ring 50 is coaxially aligned with the fixing thread hole 44. A first end of the toothed ring 50 extends into the first opening 203 of the main body 20. A second end of the toothed ring 50 extends out from the main body 20. A first thread 52 is formed on an outer circumference of the first end of the ring body 51 inside the main body 20 for coaxially screwing into the fixing thread hole 44. A second thread 53 is formed on an outer circumference of the second end of the ring body 51 outside the first opening 203 of the main body 20. Multiple axially extending teeth 54 are annularly arranged on an inner circumference of the ring body 51.

The operating end piece 60 has a cylindrical connecting end 61 with a predetermined outer diameter. A connecting thread 62 is formed on an outer circumference of the connecting end 61.

The adjustment threaded bush 70 has a first inner thread section 701 and a second inner thread section 702. The first inner thread section 701 can be screwed with the connecting thread 62 of the operating end piece 60. The second inner thread section 702 can be screwed with the second thread 53 of the toothed ring 50. Accordingly, the operating end piece 60 can be connected with the toothed ring 50. A transmission gear 63 is disposed at the connecting end 61 of the operating end piece 60. A planet gear assembly is disposed in the toothed ring 50 and engaged with the output shaft 31. The transmission gear 63 extends into the toothed ring 50 to engage with the planet gear assembly. Accordingly, via the planet gear assembly, the power output by the motor 30 can be transmitted to the operating end piece 60 to work on a work piece.

According to the above arrangement, two ends of the toothed ring 50 are both fixed so that the connecting strength of the toothed ring 50 is better than the prior art. Also, the toothed ring 50 partially extends out of the main body 20 so that it is easier to replace the operating end piece. In addition, it is easier to replace the planet gear assembly for providing different torque output.

Figure 4:
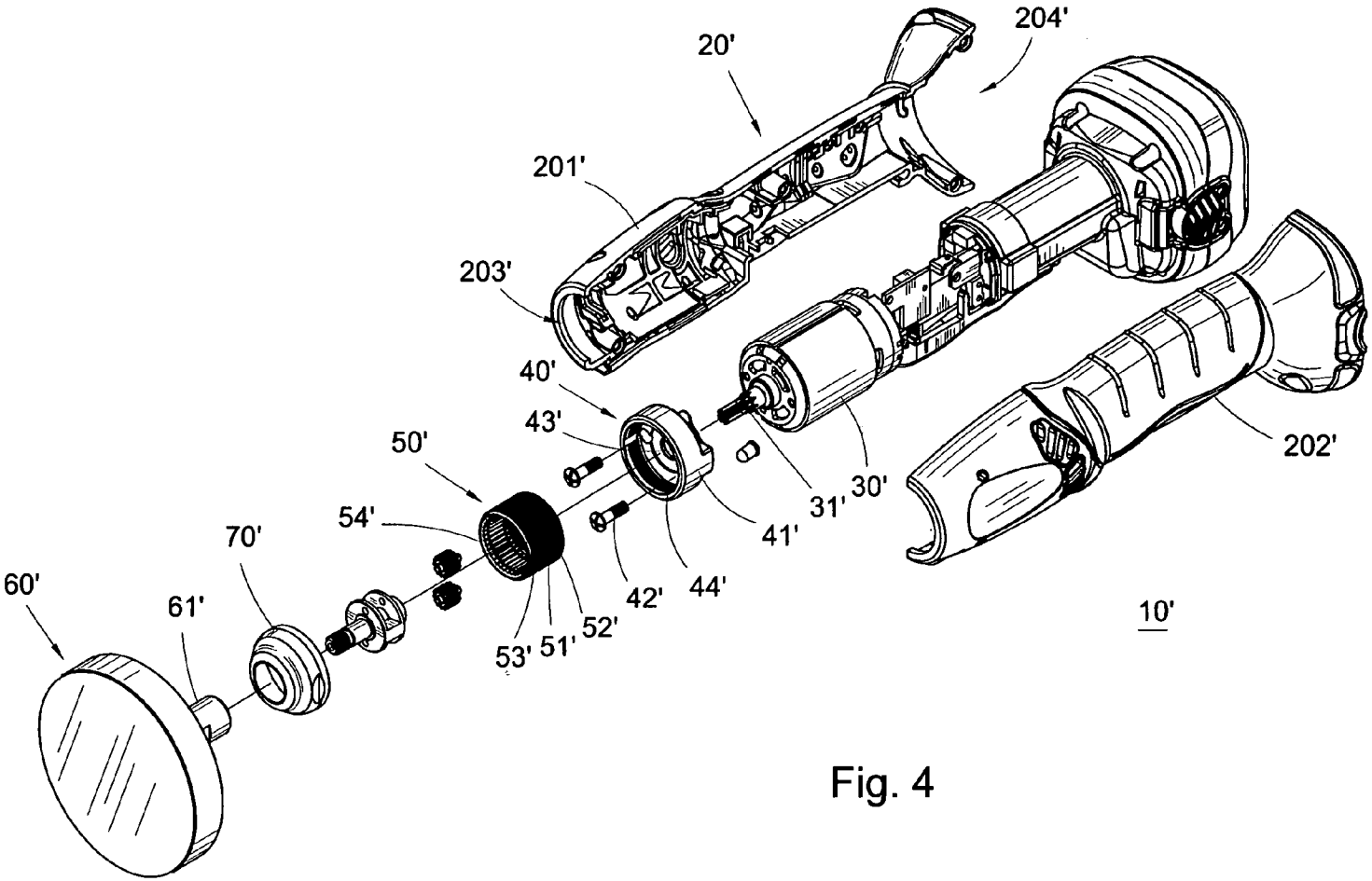
FIG. 4 is a perspective exploded view of a second embodiment of the present invention.
Figure 5:
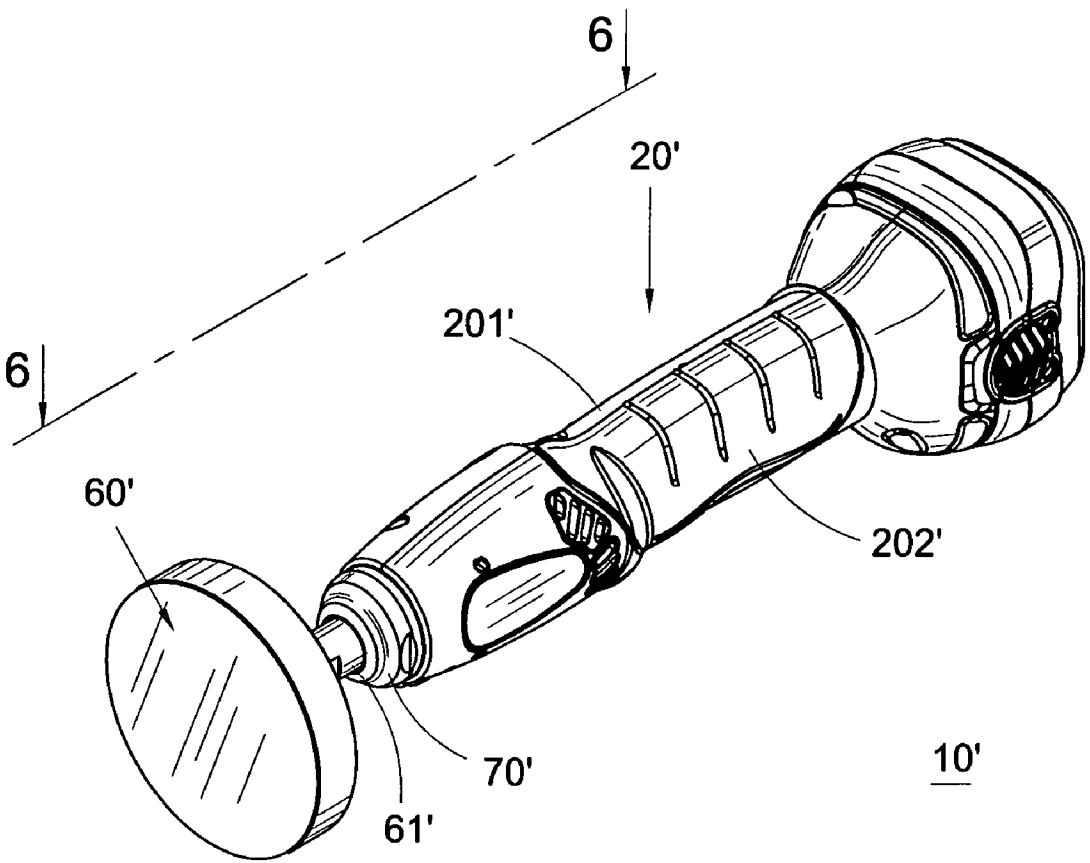
FIG. 5 is a perspective assembled view of the second embodiment of the present invention.
Figure 6:
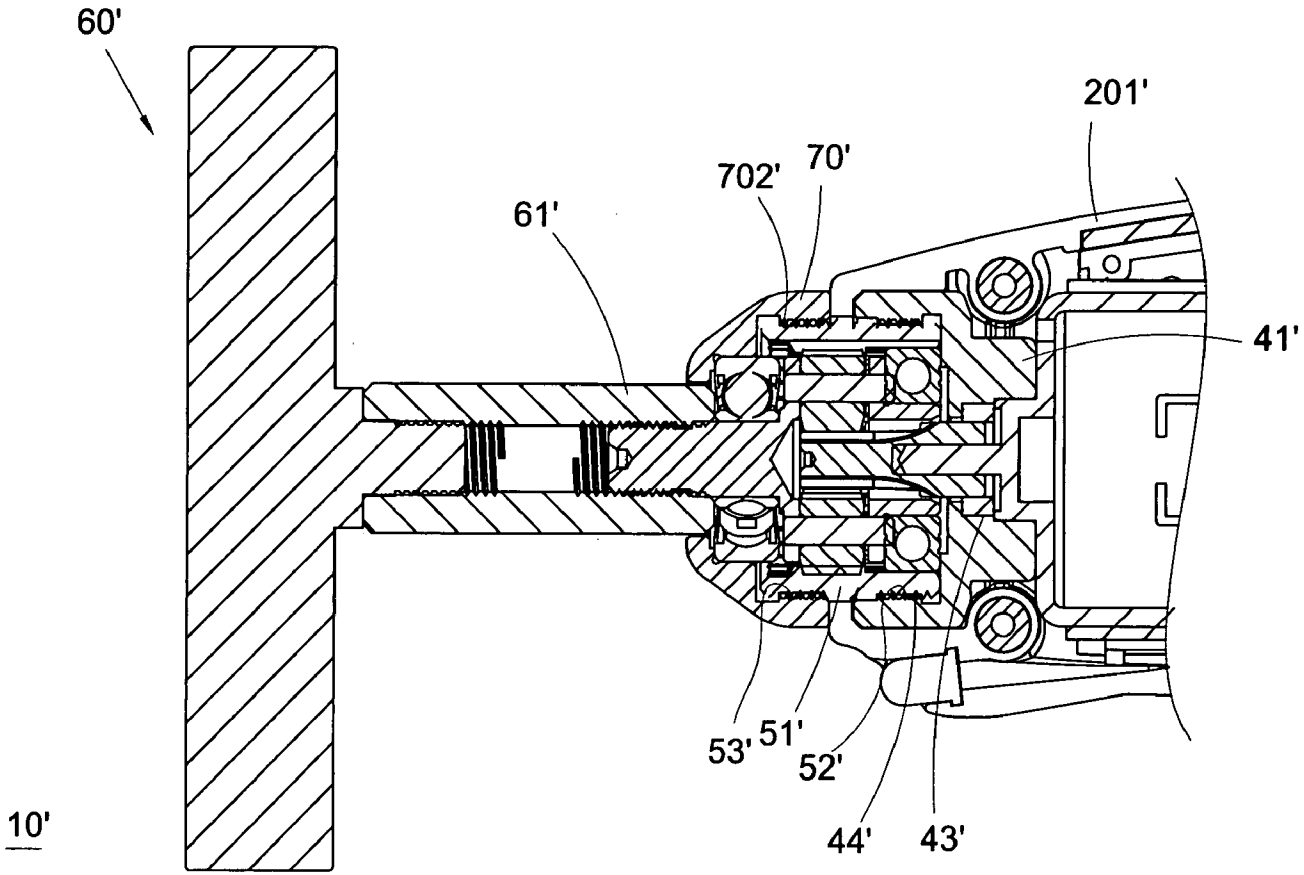
FIG. 6 is a sectional view taken along line 6-6 of FIG. 5.
Figure 7:
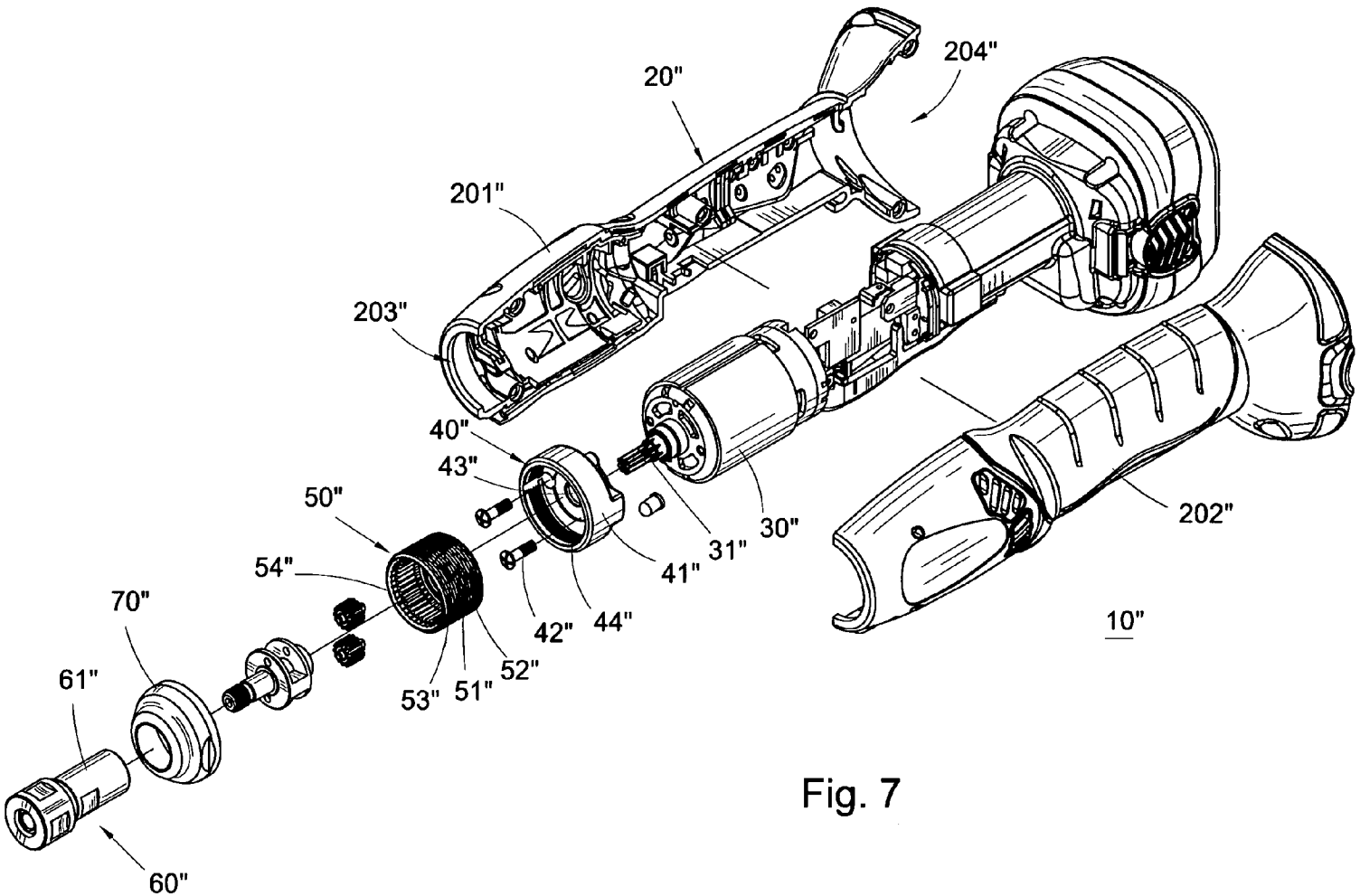
FIG. 7 is a perspective exploded view of a third embodiment of the present invention.
Figure 8:
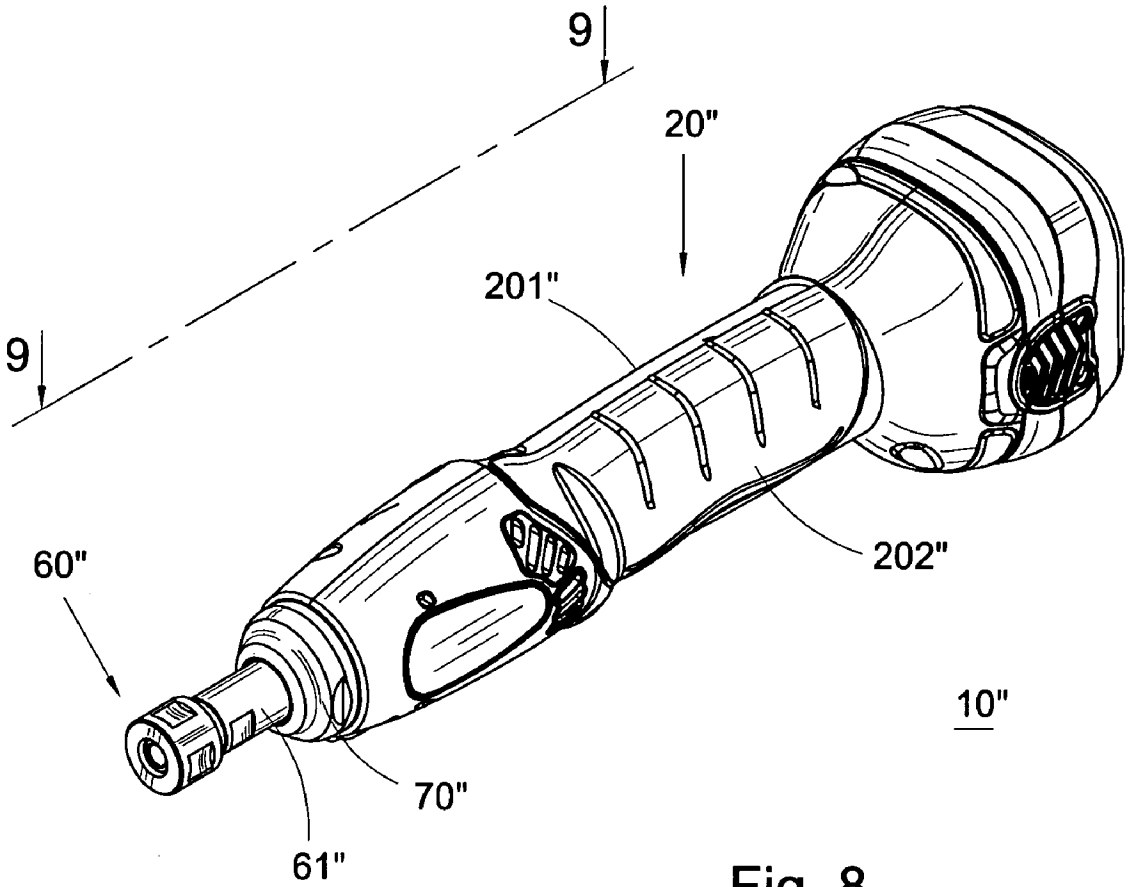
FIG. 8 is a perspective assembled view of the third embodiment of the present invention.
Figure 9:
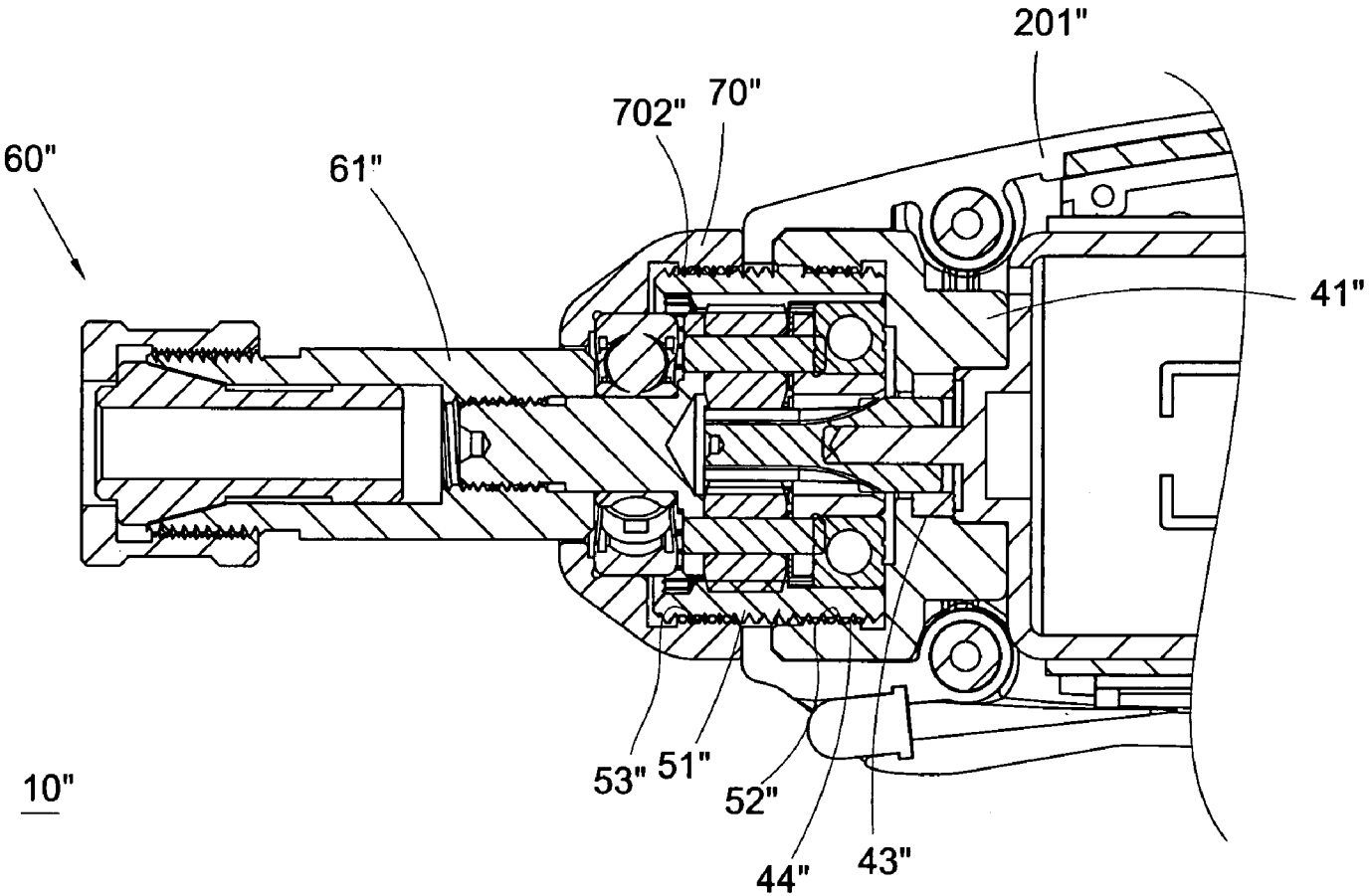
FIG. 9 is a sectional view taken along line 9-9 of FIG. 8.

Substantially, the operating end piece pertains to prior art. In a first embodiment, the operating end piece 60 can be an operating end piece of a ratchet wrench. Alternatively, in a second embodiment of the present invention, the operating end piece 60' can be an operating end piece of a buffing machine as shown in FIGS. 4 to 6. Still alternatively, in a third embodiment of the present invention, the operating end piece 60" can be an operating end piece of a screwdriver as shown in FIGS. 7 to 9. The second and third embodiments are different from the first embodiment only in that the connecting structure for connecting the adjustment threaded bush with the connecting end of the second and third embodiments is different from that of the first embodiment.

However, such connecting structure pertains to prior art and will not further described hereinafter. Any of the conventional operating end pieces can be selectively used as the operating end piece of the present invention.

The above embodiments are only used to illustrate the present invention, not intended to limit the scope thereof. Many modifications of the above embodiments can be made without departing from the spirit of the present invention.

What is claimed is:

1. A toothed ring connecting structure of a power tool, comprising:

a main body with a predetermined length, the main body having an interior space and a first opening and a second opening at two ends;

a motor accommodated in the interior space of the main body, the motor having an output shaft extending from a first end of the motor in parallel to an axis of the main body;

a fixing cap having a body section, a first end of the body section being fixed with the first end of the motor, the body section being formed with a shaft hole through which the output shaft of the motor is coaxially fitted, a second end of the body section being formed with a fixing thread hole with a predetermined inner diameter, the fixing thread hole inward axially extending from the second end of the body section by a predetermined depth, the fixing thread hole coaxially communicating with the shaft hole, a free end of the output shaft being positioned within the fixing thread hole;

a toothed ring having a ring body coaxially aligned with the fixing thread hole, a first end of the toothed ring extending into the first opening of the main body, a second end of the toothed ring extending out from the main body, a first thread being formed on an outer circumference of the first end of the ring body inside the main body for coaxially screwing into the fixing thread hole, a second thread being formed on an outer circumference of the second end of the ring body outside the first opening of the main body;

an operating end piece having a connecting end with a predetermined outer diameter; and an adjustment threaded bush, one end of the adjustment threaded bush being coaxially screwed with the second thread of the toothed ring, the other end of the adjustment threaded bush being connected with the connecting end of the operating end piece, whereby the operating end piece is connected with the toothed ring.

2. The toothed ring connecting structure of a power tool as claimed in claim 1, wherein the main body is composed of two casings mated with each other.

3. The toothed ring connecting structure of a power tool as claimed in claim 1, wherein the body section of the fixing cap is fixed with the motor with bolts.

4. The toothed ring connecting structure of a power tool as claimed in claim 1, wherein the first thread and the second thread are formed on the outer circumference of the ring body and spaced from each other.

5. The toothed ring connecting structure of a power tool as claimed in claim 1, wherein multiple axially extending teeth are annularly arranged on an inner circumference of the toothed ring, a predetermined number of planet gears being disposed in the toothed ring and engaged with the output shaft of the motor.

6. The toothed ring connecting structure of a power tool as claimed in claim 1, wherein a connecting thread is formed on an outer circumference of the connecting end of the operating end piece, whereby the connecting end of the operating end piece can be screwed into the other end of the adjustment threaded bush.

* * * * *